US006318334B1

(12) United States Patent
Reale et al.

(10) Patent No.: US 6,318,334 B1
(45) Date of Patent: Nov. 20, 2001

(54) METHOD FOR SPARKING ENGINE CYLINDERS AFTER FUEL SHUTDOWN FOR REDUCED EMISSIONS

(75) Inventors: Michael J Reale, Royal Oak; Thomas A Larson, Bloomfield Hills; Kenneth P DeGroot, Macomb Township; Bruce H Teague, Grosse Pointe Park, all of MI (US)

(73) Assignee: DaimlerChrysler Corporation, Auburn Hills, MI (US)

( * ) Notice: Subject to any disclaimer, the term of this patent is extended or adjusted under 35 U.S.C. 154(b) by 0 days.

(21) Appl. No.: 09/516,077

(22) Filed: Mar. 1, 2000

(51) Int. Cl.[7] ..... F02D 43/00
(52) U.S. Cl. ..... 123/198 DB
(58) Field of Search ..... 123/198 DB

(56) References Cited

U.S. PATENT DOCUMENTS

| | | | | |
|---|---|---|---|---|
| 4,768,480 | * | 9/1988 | Grenn et al. | 123/198 DB |
| 5,402,762 | * | 4/1995 | Yamada et al. | 123/198 DB |
| 5,542,403 | | 8/1996 | Borland et al. . | |
| 5,596,975 | | 1/1997 | Thomas et al. . | |
| 5,634,868 | | 6/1997 | Weber et al. . | |
| 5,809,969 | | 9/1998 | Fiaschetti et al. . | |
| 5,842,456 | | 12/1998 | Morganti . | |
| 5,901,684 | | 5/1999 | Fiaschetti et al. . | |
| 5,947,088 | | 9/1999 | DeGroot et al. . | |
| 6,003,494 | | 12/1999 | DeGroot et al. . | |

FOREIGN PATENT DOCUMENTS

03242466A * 10/1991 (JP) ..... 123/179.3

* cited by examiner

*Primary Examiner*—Tony M. Argenbright
*Assistant Examiner*—Hyder Ali
(74) *Attorney, Agent, or Firm*—Mark P. Calcaterra

(57) ABSTRACT

A method for reducing hydrocarbon emissions in an engine of a vehicle. The methodology is triggered following the switching off of the ignition by the operator. First, fuel delivery to the engine is terminated. Second, spark ignition is continued based on a predetermined parameter such as time or engine cycles following the termination of the fuel delivery. Last, spark ignition is stopped. Since combustion continues until no fuel exists in the cylinder, there is no over abundance of fuel in the catalyst at a subsequent start up. As such, the catalyst operates effectively at start up and hydrocarbon emissions are lowered.

20 Claims, 1 Drawing Sheet

METHOD FOR SPARKING ENGINE CYLINDERS AFTER FUEL SHUTDOWN FOR REDUCED EMISSIONS

FIELD OF THE INVENTION

The present invention relates generally to fuel control for internal combustion engines and, more particularly, to a method of reducing emissions in an internal combustion engine by continuing ignition events subsequent to fuel delivery termination.

BACKGROUND OF THE INVENTION

Environmental concerns have prompted government regulations to curb emissions from internal combustion engines in motor vehicles. Maximum levels of various gases, such as hydrocarbons, that may be emitted from the exhaust system of the motor vehicle are strictly regulated. As such, many attempts have been made to control exhaust system emissions.

One such attempt includes the use of a catalytic converter. In a motor vehicle, a catalytic converter is used to burn off excess emissions from the engine before the exhaust gases exit through the tailpipe. Unfortunately, immediately following a cold engine start, the catalyst of the catalytic converter can be ineffective since the catalyst requires a period of time to warm up to a temperature at which the catalyst can operate effectively to burn excess hydrocarbons. As a consequence, after engine start up, hydrocarbon emissions may initially be high due to a low temperature catalyst. To add to the problem, excess fuel in the catalyst at start up may further cool the catalyst, thereby requiring an extended period of time for the catalyst to warm up to a sufficient operating temperature.

Another attempt includes the use of fuel injectors. In a motor vehicle, fuel injection and engine control strategies are aimed at minimizing exhaust emissions while maintaining engine performance and economy. Conventional fuel injectors are typically controlled by a fuel injection pulsewidth signal in which the pulsewidth determines the amount of fuel injected into the corresponding cylinder of the engine. The fuel injection pulsewidth signal is tailored to follow a programmed target fuel injection curve. The curve is programmed to minimize emissions from the engine during vehicle operation. For example, a stoichiometric air/fuel ratio is used during most operations to reduce hydrocarbon emissions. Further, spark ignition timing can be varied in order to minimize emissions. While these methods may work well during engine operation, they do not address the high emissions that sometimes result after engine shutdown and subsequent restart. (Such as the catalyst cooling described above).

Conventional engine shutdown involves synchronized deactivation of fuel delivery and ignition events. In actuality, these deactivations often do not occur simultaneously; for example, fuel may be delivered to one or more of the cylinders after the final ignition event for that cylinder. This unburned fuel may then pass through the engine and enter into the exhaust system including the catalytic converter. After engine start up, the excess fuel slows the warming of the catalyst and high hydrocarbon emissions may result.

It is therefore desirable to provide a method of minimizing the amount of fuel delivered to the exhaust system after engine shutdown in order to reduce hydrocarbon emissions.

SUMMARY OF THE INVENTION

Accordingly, it is an object of the present invention to provide a method of reducing the amount of hydrocarbon emissions resulting from excess fuel in the exhaust system following engine shutdown.

The present invention provides a method for reducing hydrocarbon emissions in an engine of a vehicle. Following an ignition shutdown or key-off event, fuel delivery to the engine is terminated. However, spark ignition is continued based on a predetermined parameter such as time or engine cycles. Thereafter, spark ignition is stopped. This method continues combustion until no excess fuel exists in the cylinder. Since there is no over abundance of fuel in the cylinder, no fuel collects in the catalyst. As such, the catalyst quickly warms after engine start up and effectively reduces hydrocarbon emissions.

Further areas of applicability of the present invention will become apparent from the detailed description provided hereinafter. It should be understood however that the detailed description and specific examples, while indicating the preferred embodiment of the invention, are intended for purposes of illustration only, since various changes and modifications within the spirit and scope of the invention will become apparent to those skilled in the art from this detailed description.

BRIEF DESCRIPTION OF THE DRAWING

The present invention will become more fully understood from the detailed description and the accompanying drawing, wherein.

DETAILED DESCRIPTION OF THE PREFERRED EMBODIMENT

Figure 1:
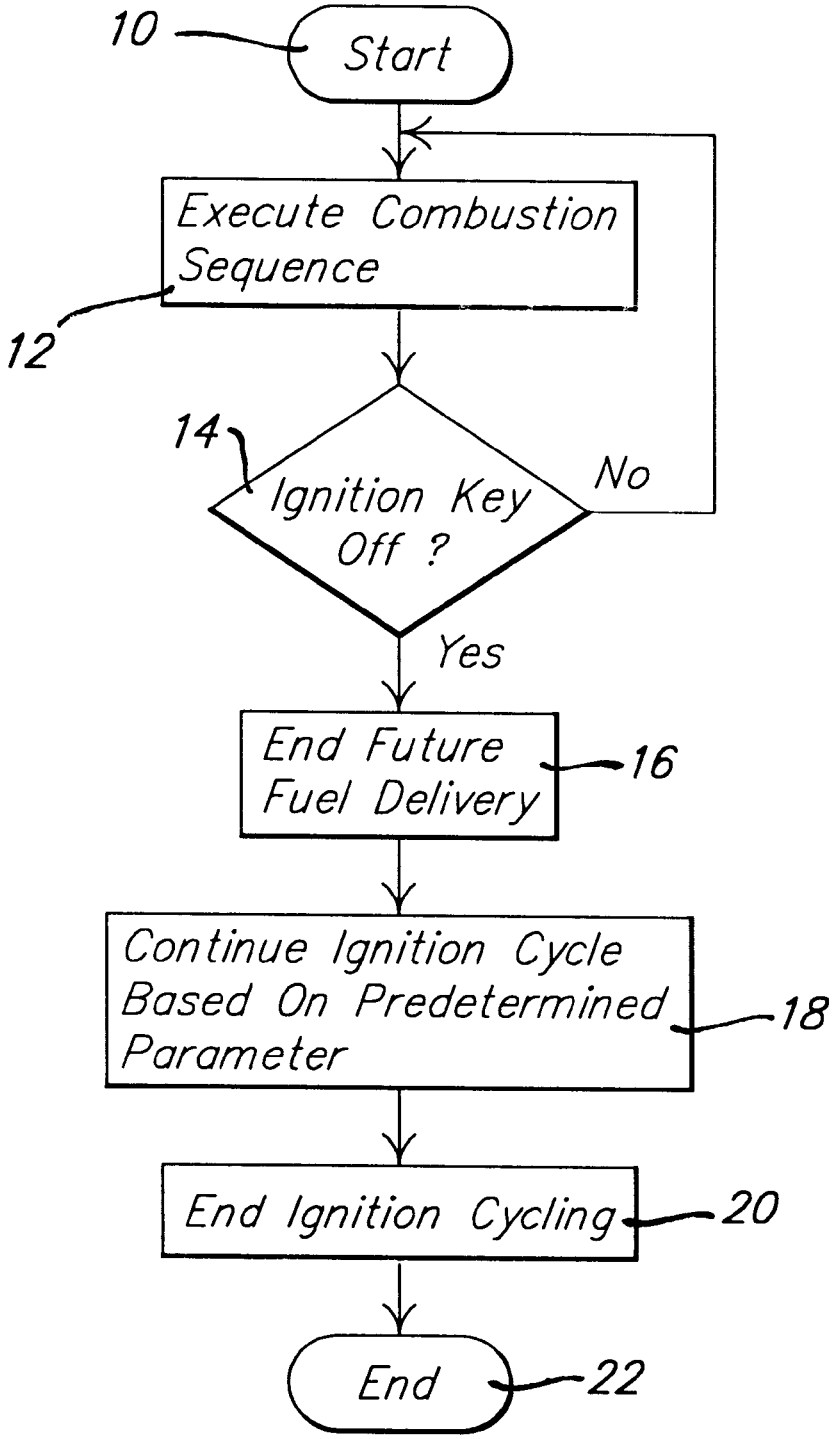
FIG. 1 is a flow diagram depicting the methodology of reducing hydrocarbon emissions by the termination of fuel delivery following engine shut down according to the principles of the present invention.

The drawing shows merely an exemplary embodiment of the present invention for purposes of illustration only. One skilled in the art will readily appreciate that various adaptations of the preferred embodiment may be made without departing from the scope of the invention.

The present invention is directed towards reducing hydrocarbon gases that emit from motor vehicles preferably equipped with an engine control unit and fuel injection. Although the engine is preferably a four stroke spark-ignited internal combustion engine, it may also be other types of internal combustion engines, such as a two stroke spark-ignited engine. In general, a spark plug is used to ignite the air/fuel mixture in the cylinder to create combustion.

Referring now to the drawing, FIG. 1 illustrates a method of controlling the amount of hydrocarbon emissions by sparking engine cylinders after fuel shutdown according to the principles of the present invention. The methodology begins in block 10 and falls through to process block 12. In process block 12, the engine is operating and performing the necessary steps to execute combustion, such as air intake, fuel delivery, air/fuel mixing, and spark ignition. In the preferred method, the engine control unit coordinates the fuel injection and spark ignition timing.

From process block 12, the methodology advances to decision block 14. In decision block 14 the methodology determines if the vehicle operator has switched the engine off. If not, the methodology returns to process block 12 and continues the combustion sequence. However, if the vehicle operator has switched the engine off, the methodology advances to process block 16.

While one skilled in the art will appreciate that the foregoing describes a continuous loop sequence, the methodology could easily be tailored for selective execution. For example, the methodology could be executed according to a pre-selected schedule. If no engine off event is detected, the methodology could end pending a subsequent execution. Further, the methodology could only be executed upon the detection of the engine off event. In this case, the start block 10 would coincide with the engine off event and the methodology would advance directly to process block 16.

In process block 16, the engine control unit deactivates fuel injection through the fuel injectors. However, the methodology allows the completion of any fuel injection event once that event has been initiated, but prevents further injections by canceling future injection events. This ensures that any cylinder will be fueled with a sufficient fuel quantity to support combustion following the deactivation of the fuel supply.

From process block 16, the methodology advances to process block 18. In block 18, the engine control unit continues the ignition cycle based on a predetermined parameter. The parameter is stored in the memory of the engine control unit. This parameter is preferably a predetermined period of time, but could also be a predetermined number of engine cycles. The predetermined parameter reflects the approximate time necessary to purge the fuel from all of the cylinders. In the preferred embodiment, the predetermined time period is approximately 0.5 seconds, although it may vary depending on parameters such as engine displacement, configuration, and ignition timing.

Prom block 18, the methodology advances to process block 20. In block 20, the methodology discontinues ignition cycling. By this time, fuel that existed in any cylinder following the termination of the fuel supply has been combusted during the fuel combustion events. From block 20, the methodology falls through to block 22 and ends.

It should now be appreciated that the present invention provides a method of reducing the hydrocarbon emissions by reducing excess fuel in the cylinder following engine shutdown. By terminating the fuel delivery prior to the termination of the spark ignition, most of the fuel is combusted during the extra engine combustion cycles. The amount of fuel entering into the exhaust system after engine shutdown is thereby minimized. Since there is not an over abundance of fuel cooling the catalyst at a subsequent engine start, the catalyst can more quickly warm up to a sufficient operating temperature. Therefore, following a cold engine start, the catalyst more effectively burns excess hydrocarbons.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A method for reducing hydrocarbon emissions in an engine comprising:

detecting an engine shutdown event;

terminating a fuel supply to the engine; and continuing an ignition cycle in the engine based on a predetermined parameter following said step of terminating said fuel supply;

wherein said predetermined parameter is a period of time;

wherein said period of time corresponds to a time period sufficient for combusting excess fuel remaining in the engine after said step of terminating said fuel supply; and wherein said period of time is approximately 0.5 seconds.

2. A method for reducing hydrocarbon emissions in an engine comprising:

detecting an engine shutdown event;

terminating a fuel supply to the engine; and continuing an ignition cycle in the engine based on a predetermined parameter following said step of terminating said fuel supply;

wherein said predetermined parameter is a period of time;

wherein said period of time corresponds to a time period sufficient for combusting excess fuel remaining in the engine after said step of terminating said fuel supply; and wherein said period of time varies according to at least one of the group including engine displacement, configuration, and ignition timing.

3. The method recited in claim 2 wherein said step of terminating a fuel supply further comprises completing a full fuel delivery of any initiated fuel delivery event.

4. The method recited in claim 2 wherein the fuel supply is provided by fuel injection.

5. The method recited in claim 2 wherein said step of terminating said fuel supply and said step of continuing said ignition cycle are controlled by an engine control unit.

6. A method for reducing hydrocarbon emissions in an engine comprising:

detecting an engine shutdown event;

terminating a fuel supply to the engine; and continuing an ignition cycle in the engine based on a predetermined parameter following said step of terminating said fuel supply;

wherein said predetermined parameter is a number of engine cycles; and wherein said number of engine cycles varies according to at least one of the group including engine displacement, configuration, and ignition timing.

7. The method recited in claim 6 wherein said number of engine cycles corresponds to a number of engine cycles sufficient for combusting excess fuel remaining in the engine after said step of terminating said fuel supply.

8. The method recited in claim 6 wherein said step of terminating a fuel supply further comprises completing a full fuel delivery of any initiated fuel delivery event.

9. The method recited in claim 6 wherein the fuel supply is provided by fuel injection.

10. The method recited in claim 6 wherein said step of terminating said fuel supply and said step of continuing said ignition cycle are controlled by an engine control unit.

11. A method for reducing a build-up of fuel in a catalytic converter of an automotive vehicle comprising:

detecting an engine shutdown event;

terminating future fuel delivery to the engine; and sparking the engine based on a predetermined parameter following said step of terminating said future fuel delivery;

wherein said predetermined parameter is a period of time; and wherein said period of time is approximately 0.5 seconds.

12. A method for reducing a build-up of fuel in a catalytic converter of an automotive vehicle comprising:

detecting an engine shutdown event;

terminating future fuel delivery to the engine; and sparking the engine based on a predetermined parameter following said step of terminating said future fuel delivery;

wherein said predetermined parameter is a period of time; and wherein said period of time varies according to at least one of the group including engine displacement, configuration, and ignition timing.

13. The method recited in claim 12 wherein said period of time corresponds to a time period sufficient for combusting excess fuel remaining in the engine after said step of terminating said fuel supply.

14. The method recited in claim 12 wherein the fuel supply is provided by fuel injection.

15. The method recited in claim 12 wherein said step of terminating said fuel supply and said step of continuing said ignition cycle are controlled by an engine control unit.

16. A method for reducing a build-up of fuel in a catalytic converter of an automotive vehicle comprising:

detecting an engine shutdown event;

terminating future fuel delivery to the engine; and sparking the engine based on a predetermined parameter following said step of terminating said future fuel delivery;

wherein said predetermined parameter is a number of engine cycles; and wherein said number of engine cycles varies according to at least one of the group including engine displacement, configuration, and ignition timing.

17. The method recited in claim 16 wherein said number of engine cycles corresponds to a number of engine cycles sufficient for combusting excess fuel remaining in the engine after said step of terminating said fuel supply.

18. The method recited in claim 16 wherein the fuel supply is provided by fuel injection.

19. The method recited in claim 16 wherein said step of terminating said fuel supply and said step of continuing said ignition cycle are controlled by an engine control unit.

20. The method recited in claim 16 wherein said step of terminating said future fuel delivery further comprises completing a full fuel delivery of any initiated fuel delivery event.

* * * * *